United States Patent [19]

Mizelle

[11] Patent Number: 5,007,679

[45] Date of Patent: Apr. 16, 1991

[54] RECLINING CHAIR

[76] Inventor: Ned W. Mizelle, P.O. Box 5985, High Point, N.C. 27285

[21] Appl. No.: 364,377

[22] Filed: Jun. 12, 1989

[51] Int. Cl.[5] ..... A47C 1/02

[52] U.S. Cl. ..... 297/374; 297/417; 297/340; 297/68; 297/327

[58] Field of Search ..... 297/379, 325, 327, 328, 297/329, 340, 341, 342, 430, 417, 326

[56] References Cited

U.S. PATENT DOCUMENTS

| | | | |
|---|---|---|---|
| 3,096,119 | 7/1963 | Fletcher | 297/340 X |
| 3,515,433 | 6/1970 | Tabor | 297/374 |
| 4,155,588 | 5/1979 | Danziger et al. | 297/417 |
| 4,216,994 | 8/1980 | Benoit | 297/417 X |
| 4,244,620 | 1/1981 | Harrison et al. | 297/342 X |
| 4,287,619 | 9/1981 | Brewer et al. | 297/417 X |
| 4,628,552 | 12/1986 | Magistretti | 297/417 X |
| 4,715,654 | 12/1987 | Laskauitz | 297/329 |
| 4,813,743 | 3/1989 | Mizelle | 297/357 |
| 4,844,536 | 7/1989 | Mizelle | 297/68 |
| 4,878,710 | 11/1989 | Tacker | 297/68 |

*Primary Examiner*—Peter A. Aschenbrenner
*Attorney, Agent, or Firm*—Beveridge, DeGrandi & Weilacher

[57] ABSTRACT

A chair assembly is mounted on a base member by a pivot that permits the chair assembly to tilt rearwardly from first position to a second position. The chair assembly includes a seat, a legrest that is forwardly extendible from the seat, and a back that is tiltable relative to the seat between a generally upright sitting position and a reclining position. When the chair assembly is at its rearwardly tilted second position, the legrest is in its extended position, and the back is in its reclining position, the head and ankles of an occupant are substantially at the same height for use in medical treatment in which the Trendelenburg is indicated. A releasable locking mechanism holds the cair assembly at a selected inclination angle relative to the base member. The locking mechanism has blades that are permanetly connected to the base and slidably connected to the tiltable chair assembly by a rod that extends through slots in the blades. Rotation of teh rod applies lateral pressure on the blades to lock the blades frictionally to the chair assembly. The chair assembly has arms that are located on opposite sides of the seat. A dropleaf table member is hinged to one arm, and this arm can swing down laterally below the height of the seat to enable attendants to move an occupant onto or off of the chair. When the arm is in this position, the dropleaf table member is vertical to act as a supporting leg.

13 Claims, 3 Drawing Sheets

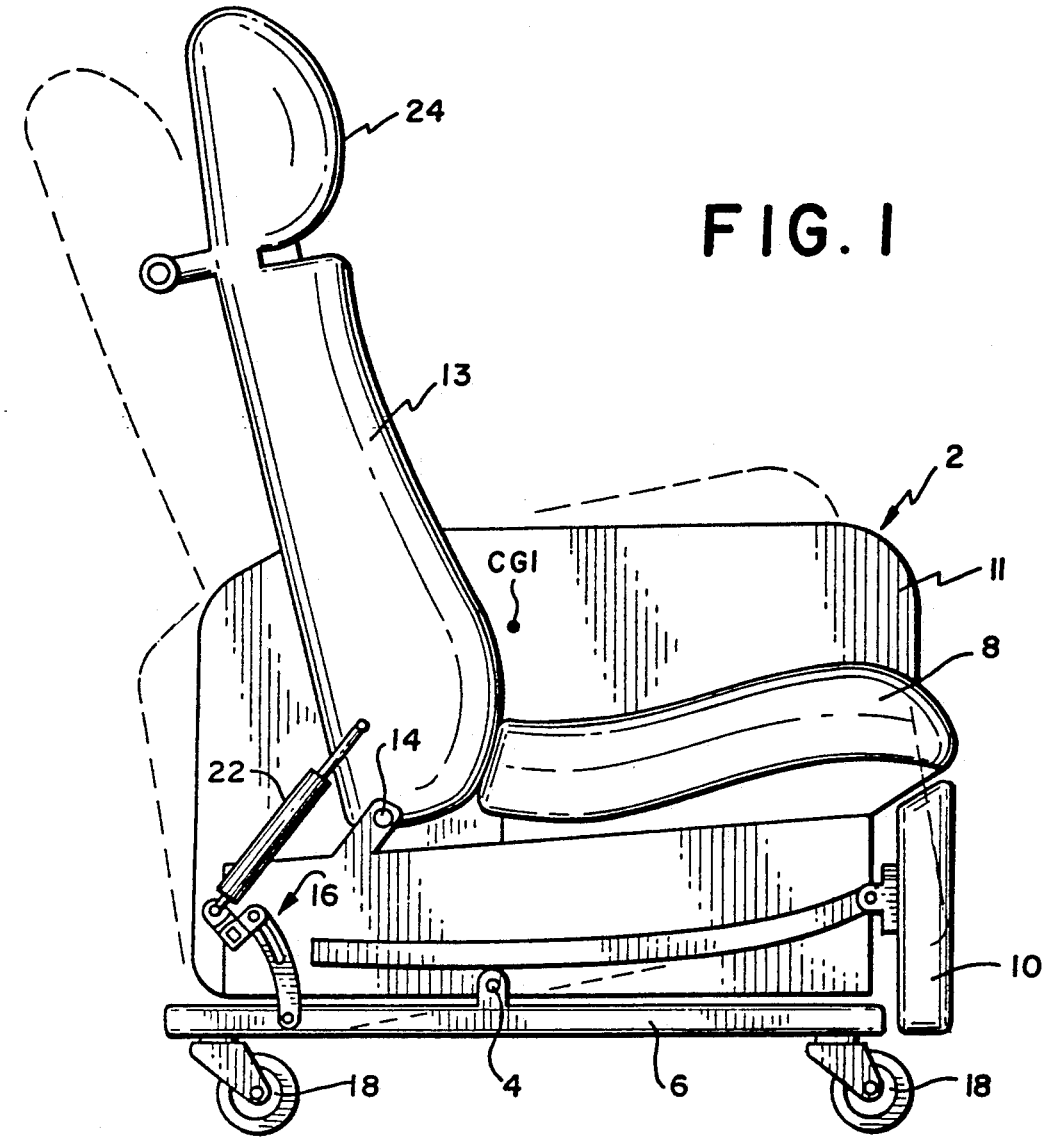
FIG. 1
FIG. 2
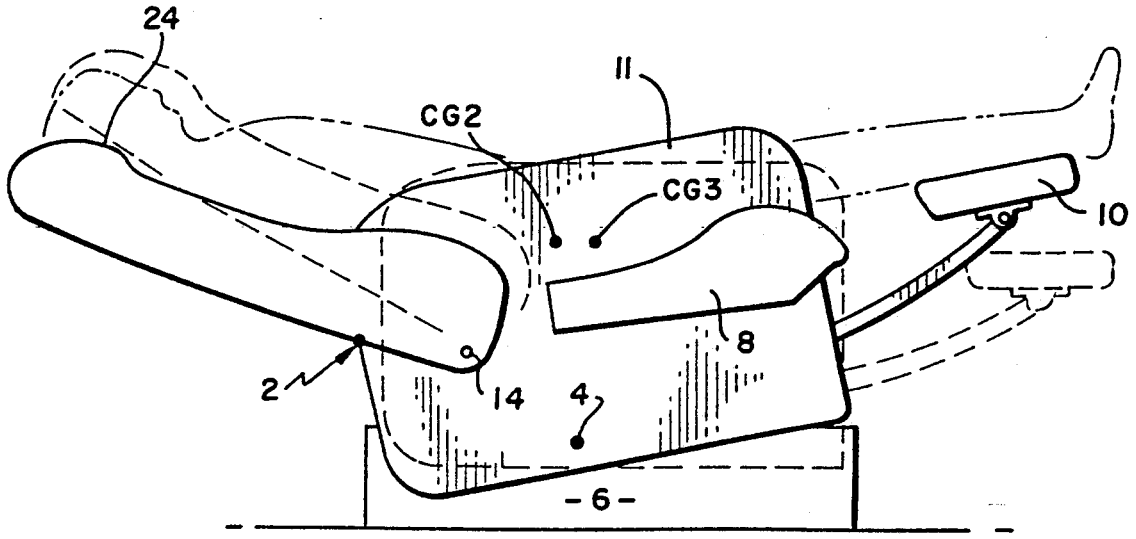

RECLINING CHAIR

BACKGROUND

This invention relates to a reclining chair which is particularly suited for use in hospitals and other healthcare facilities.

Heretofore, there have been a number of reclining chairs having seats, extensible legrest and reclining backs. The relative movement between these components is possible due to simple pivotal connections or complex mechanical movements. In general, however, the extent of reclining movement is such that the occupant's feet often do not rise to a height that is approximately equal to or greater than the height of the occupant's head. Such a position, generally referred to herein as the "Trendelenburg position," is used in connection with many different medical and therapeutic treatments. The present invention presents a relatively uncomplicated article of furniture which is extremely versatile and is capable of supporting an occupant in a Trendelenburg position.

The chair according to the invention has a number of features which are well suited to the healthcare environment. For example, it is readily movable from room-to-room or through corridors; it may have a dropleaf table mounted on its arm; an arm can be swingable laterally and downwardly to permit lateral movement of an occupant; the chair is capable of placing an occupant in many different positions for personal comfort or for facilitating medical treatments.

SUMMARY OF THE INVENTION

According to the invention a chair assembly has a seat, and a back that is tiltable relative to the seat from a generally upright sitting position to a generally horizontal reclining position. The chair assembly is connected to a base member by a pivot means which allows pivotal movement about an axis that is fixed relative to the base member and the chair assembly. The chair assembly including the seat and the back is rearwardly tiltable on the pivot means for movement from a first position to a second position; and, releasable locking means are provided for holding the chair assembly at a fixed inclination angle relative to the base member.

Preferably, the chair has a legrest that is forwardly extendible from the seat, and the chair configuration supports an occupant in a Trendelenburg position when the legrest is extended, the back is in its generally horizontal reclining position, and the chair assembly is tilted to its rearward position so that the legrest is at least about as high as a headrest portion of the back.

The chair assembly preferably includes a pair of arms that lie on opposite sides of the seat to confine the occupant laterally. One of these arms is a planar member that swings laterally and down from a vertical position to a horizontal position. When the arm is in its vertical position, it is higher than the seat in order to confine an occupant laterally, but when the arm is moved to its horizontal position, hospital attendants can move the occupant laterally from the seat and off of the chair. A dropleaf table member can be pivoted to the arm and arranged so that the table member will be vertical when the arm is in its horizontal position, so that the table member acts as a support leg for the arm.

The locking means which holds the chair assembly at a fixed inclination angle relative to the base member has two portions that are mounted respectively on the chair assembly and the base member. A plurality of blades are permanently connected to a first one of these portions, and these blades are slidably connected to a second of these portions. The second portion has a compressing means for exerting lateral pressure on the blades to lock them frictionally to the second portion. This compressing means is releasable to unlock the blades from the second portion to allow for movement of the chair assembly between its first and second positions. Preferably, the pressing means is a mechanism connected to a rod that extends through slots in the blades, and the mechanism acts to tension the rod and compress the blades.

For effective operation, the inclinable chair assembly is constructed and mounted so that its center of gravity is forward of the pivot axis that connects the chair assembly to the base, so that the weight of the chair assembly will tend to move it toward its forward position when the chair back is in its generally upright sitting position. However, when the back is in its reclining position, the center of gravity of the chair assembly is such that it passes over center of the base-to-chair pivot axis when an occupant is sitting on the chair. Due to this arrangement, the weight of the chair assembly will move it toward either its first or second positions where it will tend to be stable.

BRIEF DESCRIPTION OF THE DRAWINGS

FIG. 1 is a side view of a chair constructed according to the invention, with portions thereof broken away and shown in section.

FIG. 2 is a diagrammatic side view of the chair with the legrest extended and the chair back in its reclined position.

DETAILED DESCRIPTION

Figure 3:
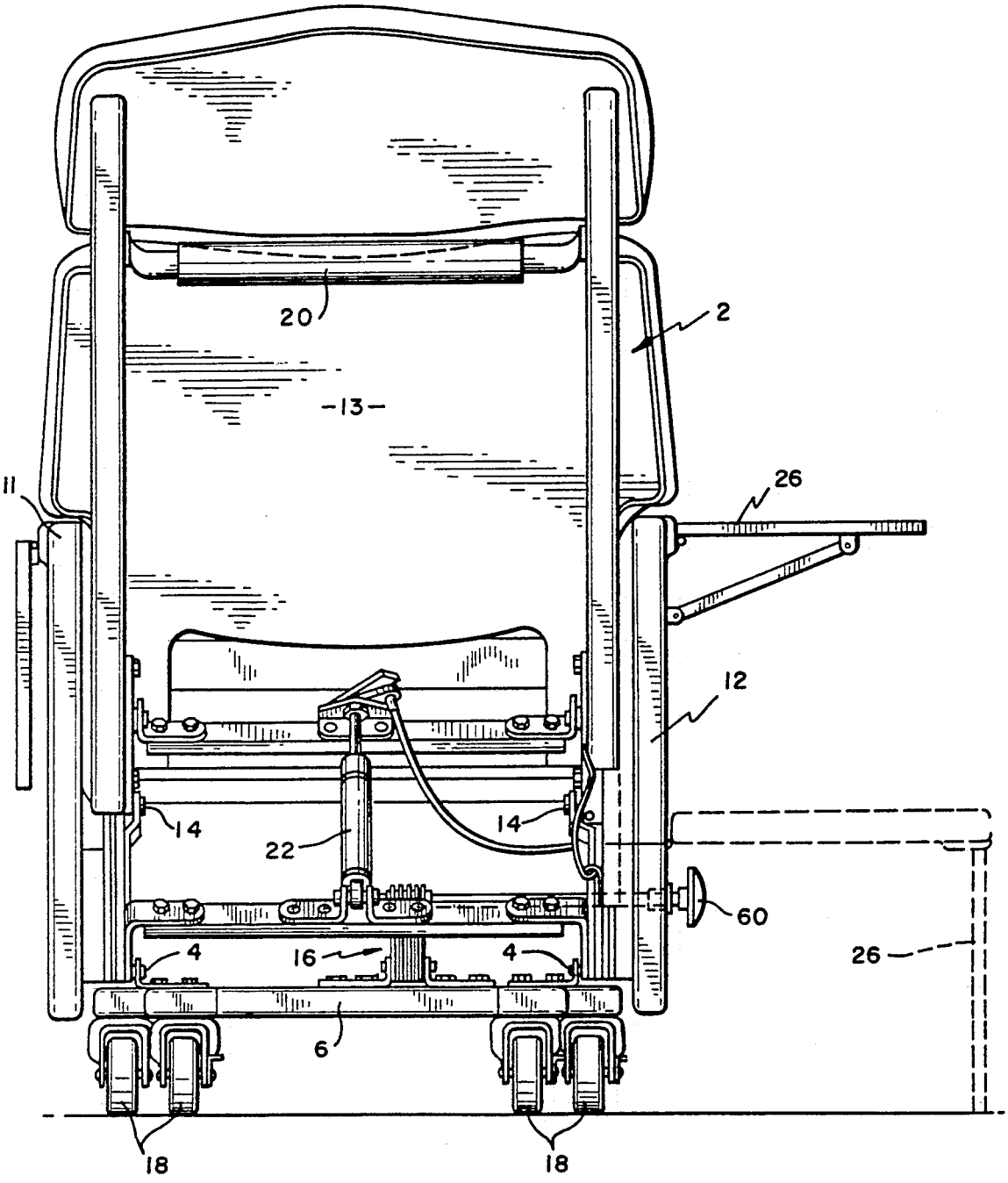
FIG. 3 is a rear view of the chair, with portions thereof removed for illustrative purposes, showing a dowmwardly swingable chair arm that permits lateral movement of a paralyzed or comatose patient off of the chair.

As shown in FIG. 1, a reclining chair according to the invention includes a chair assembly 2 pivotally connected by pivot means 4 to a base member 6. The chair assembly 2 includes a seat 8, a legrest 10 that is forwardly extendible from the seat, arms 11 and 12 located on opposite sides of the seat 8 to confine an occupant laterally, and a back 13 that is tiltable relative to the seat on a pivot 14 from a generally upright sitting position to a generally horizontal reclining position. The chair assembly including the chair seat 8 and chair back 13 is rearwardly tiltable on the pivot 4 for movement from a first position to a second position, and a releasable locking mechanism 16 is provided for holding the chair assembly 2 at a fixed inclination angle relative to the base 6.

For convenience in moving the chair from place to place, the base 6 has four heavy duty casters 18. A transverse handle 20 mounted on the chair back 13 is particularly convenient for pushing the chair on the casters, and for inclining the chair back 13 and overall chair assembly for occupants who are unable to do so by themselves.

Preferred mechanisms for connecting the chair back to the seat and for supporting the legrest are fully disclosed in U.S. Pat. applications 067825 and 067826, both filed June 30, 1987, now U.S. Pat. No. 4,813,743 and 4,844,536, the entire contents of which are incorporated herein by reference. The chair back mechanism has a lockable gas spring 22 that assists in the chair back movement. The legrest mechanism has a latching means for holding the legrest in its retracted position. When the latching means is released, a spring reel biases the legrest to its extended position where it again can be latched at a selected position. Manually operable remote control levers are provided on one of the chair arms 11 or 12 for releasing the legrest latch and for releasing the normally locked backrest gas spring.

When, as shown in solid lines in FIG. 2, the legrest 10 is extended, the chair back 13 is in its generally horizontal reclining position, and the chair assembly 2 is tilted to its rearward position, the occupant will be supported in a Trendelenburg position. This is because the legrest 10 is at least about as high as, i.e. within about three inches of being as high as, the headrest portion 24 of the back 13.

When the back 13 is in its generally upright sitting position and the chair assembly 2 is in its rearwardly tilted position as shown in broken lines in FIG. 1, the center of gravity CG1 of the chair assembly is forward of the base pivot 4, thus causing the chair assembly to move gravitationally toward its forward position.

However, as shown in FIG. 2, when the back 13 is in its reclining position and the chair is occupied by a seated man or woman of average height and weight, the center of gravity of the chair assembly and occupant will be located at a point that moves over center from CG2 to CG3 with respect to the base pivot axis 4 when the chair assembly is pivoted from its forward position shown in broken lines to its rear position shown in solid lines. Due to this relationship, the chair assembly 2 will be stable in both its forward and rear positions. As will be understood from FIG. 2, when the chair assembly is in its forward position, the center of gravity CG2 will be forward of the pivot axis 4 so that the weight of the chair moves it toward the forward or horizontal position. However, when the chair assembly in the same configuration is positioned so that it is tilted rearwardly as shown in solid lines in FIG. 2, i.e. in its second position, the center of gravity will be at CG3 behind the pivot axis 4, causing the chair assembly to move gravitationally toward the position shown in solid lines.

To facilitate the task of moving comatose, weak or paralyzed persons off of the chair, the arm 12 is preferably hinged as shown in FIG. 3. This permits the arm 12 to swing laterally down from a vertical position to a horizontal position. When in the vertical position shown in solid lines, the arm 12 is higher than the seat in order to confine an occupant laterally in the seat. When the arm 12 is moved to its horizontal position, however, it is possible for hospital attendants to move an occupant laterally from the seat and off of the chair.

A dropleaf table member 26 is hinged to the arm as shown in FIG. 3. When the arm 12 is in its normal vertical position, the table 26 can be raised to a horizontal position or lowered to a vertical stored position to suit the needs or convenience of the occupant. Then, when the arm 12 is swung laterally down to its horizontal position as described above, the table member 26 will be vertical as shown in broken lines, with its lower edge resting on the floor to provide a support leg for the arm 12 of the chair.

Figure 5:
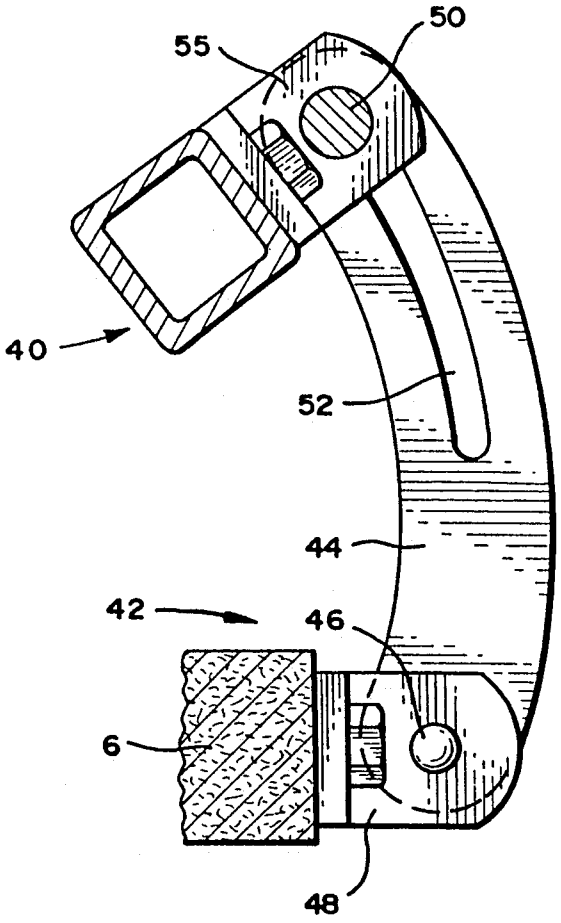
FIG. 5 is a transverse sectional view of the releasable locking mechanism.
Figure 4:
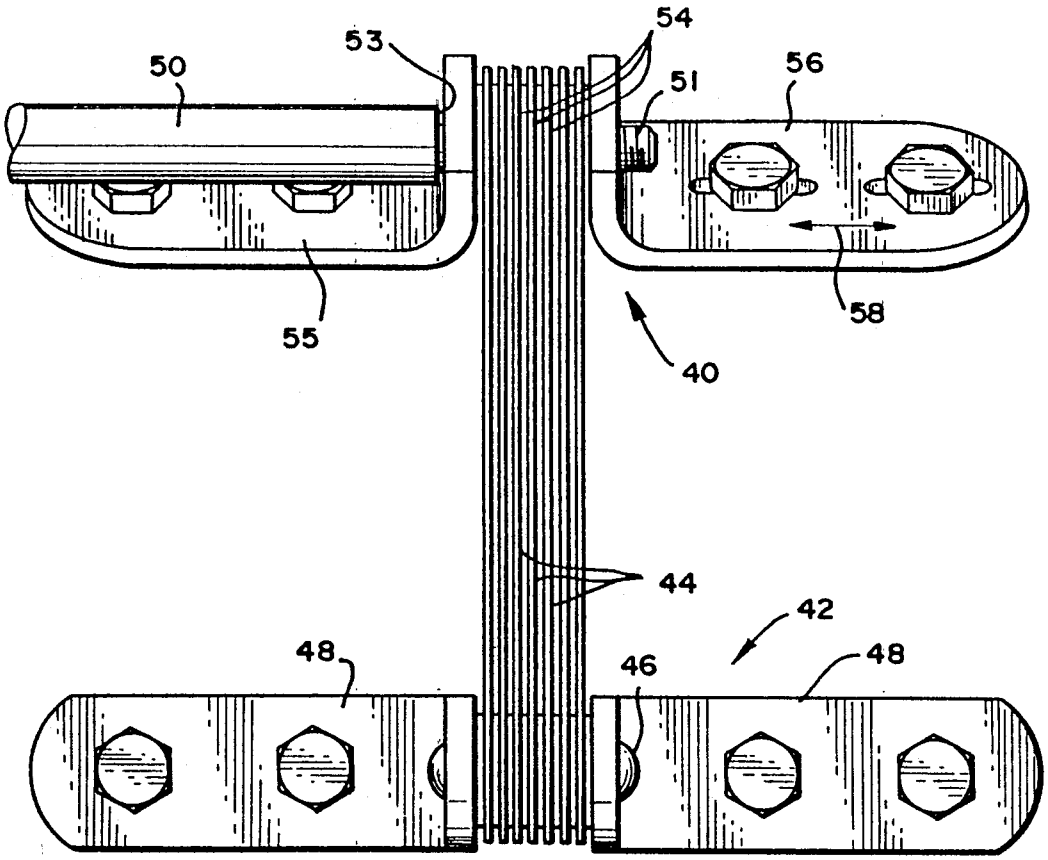
FIG. 4 is an enlarged elevational view of the releasable locking mechanism that locks the chair assembly in any selected inclined position.

As mentioned above, a locking mechanism 16 is used to hold the chair assembly 2 at a fixed inclination angle relative to the base member 6. As shown in FIGS. 4 and 5, this mechanism includes a chair-mounted portion 40 and a base-mounted portion 42. A plurality of flat blades 44 of arcuate configuration are permanently connected to the base 6 by a pivot pin 46 and brackets 48. The upper ends of the blades are slidably connected to the chair in the respect that a rod 50 has a threaded reduced diameter portion 51 that extends through slots 52 in the blades. Annular metal spacers 54 are located between adjacent blades 44. The rod has a shoulder 53 that is engageable against a stationary bracket 55 to limit its axial movement, and it is threaded to a bracket 56 that is slidable in the direction shown by the arrow 58. A manually accessible knob 60 shown in FIG. 3 or a lever-operated cam is provided at the end of the rod 50. When the knob 60 is rotated, the rod 50 rotates and its threads cause the bracket 56 to slide toward and away from the blades 44 and spacers 54. When the bracket 56 moves toward the blades, the blades 44 are laterally compressed, the reduced diameter portion of rod 50 is tensioned between the brackets 55 and 56, and the lateral compression of the blades will lock the blades frictionally to the chair assembly 2. When the knob 60 is turned in the opposite direction, this releases the friction to unlock the blades 44 so that the chair assembly 2 may move on pivot 4 to its various inclined positions.

From the foregoing, it will be appreciated that the invention provides a relatively uncomplicated but highly functional adjunct for healthcare facilities.

Individuals familiar with furniture construction will readily see that the invention may take many forms other than the single embodiment described in this specification. Therefore, it is emphasized the invention is not limited to the disclosed embodiment but is embracing of modifications and variations which fall within the spirit of the following claims.

I claim:

1. A reclining chair, comprising, a base member, a chair assembly including a seat and a back, said back being tiltable relative to the seat from a generally upright sitting position to a generally horizontal reclining position, a pivot means connecting the chair assembly to the base member for pivotal movement about a pivot axis that is fixed relative to the base member and the chair assembly, said chair assembly being rearwardly tiltable on the pivot means for movement from a first position to a second position, releasable locking means for holding the chair assembly at a fixed inclination angle relative to said base member, said chair assembly, when the back is in said reclining position and the chair assembly is in its first position with an occupant seated thereon, having a center of gravity that is forward of the pivot axis so that the weight of the chair assembly moves it toward said first position; and, said center of gravity, when the back is in said reclining position and the chair assembly is in its second position, being behind the pivot axis so that the weight of the chair assembly moves it toward said second position, whereby the chair will be stable in both of said first and second positions.

2. A reclining chair according to claim 1 wherein the chair assembly includes arms located on opposite sides of the seat, and a legrest that is forwardly movable relative to the seat from a retracted position to an extended position where it supports the legs of an occupant.

3. A reclining chair according to claim 2 wherein one said arm is a planar member that is laterally swingable from a vertical position to a horizontal position to permit movement of an occupant laterally from said seat and off of the chair.

4. A reclining chair according to claim 3 wherein said arm has a dropleaf table member pivoted thereto, said table member being movable to a position where it is vertical when the one arm is in its horizontal position, thus providing a support leg for the one arm when an occupant is being moved laterally from the chair.

5. A reclining chair according to claim 2 wherein, when the back is in said sitting position and the chair assembly is in said second position, the chair assembly has a center of gravity that is forward of the pivot axis so that the weight of the chair assembly moves it toward said first position.

6. A reclining chair according to claim 2 having a legrest that is extended forwardly from the seat, said back being at said generally horizontal reclining position, and said chair assembly being rearwardly tilted about said pivot means to its second position, said back having a headrest portion, said legrest being at least about as high as the headrest portion so an occupant's feet will be at a height approximately equal to or greater than the occupant's head.

7. A reclining chair according to claim 6 having arms provided on opposite sides of the seat.

8. A reclining chair according to claim 1 having a legrest that is extended forwardly from the seat, said back being at said generally horizontal reclining position, and said chair assembly being rearwardly tilted about said pivot means to its second position, said back having a headrest portion, said legrest being at least about as high as the headrest portion so an occupant's feet will be at a height approximately equal to or greater than the occupant's head.

9. A reclining chair according to claim 8 having arms provided on opposite sides of the seat.

10. A reclining chair according to claim 1 wherein, when the back is in said sitting position and the chair assembly is in said second position, the chair assembly has a center of gravity that is forward of the pivot axis so that the weight of the chair assembly moves it toward said first position.

11. A reclining chair according to claim 1 wherein said locking means includes two portions that are mounted respectively on said chair assembly and on said base member, a plurality of blades that are permanently connected to a first said portion and are slidably connected to a second said portion, said second portion having a compressing means for exerting lateral pressure on said blades to lock said blades frictionally to said second portion, said compressing means being releasable to unlock said blades from said second portion to allow for movement of said chair assembly between said first and second positions.

12. A reclining chair according to claim 11 wherein said blades are provided with slots, said second portion having a rod that passes through said slots, and said compressing means is a mechanism connected to said rod for tensioning said rod and compressing said blades.

13. A reclining chair according to claim 12 wherein the compressing means includes threads on said rod.

* * * * *